United States Patent [19]

Stallard

[11] 4,258,969

[45] Mar. 31, 1981

[54] REVERSING PLUG CONNECTOR

[76] Inventor: Jerrel L. Stallard, 4716 Mountain Rd., N.E., Albuquerque, N. Mex. 87110

[21] Appl. No.: 95,361

[22] Filed: Nov. 19, 1979

[51] Int. Cl.[3] ..... H01R 29/00

[52] U.S. Cl. ..... 339/14 P; 318/739; 339/32 R

[58] Field of Search ..... 339/14 R, 14 P, 18 R, 339/18 P, 31 R, 31 M, 32 R, 32 M, 218 R, 218 M; 200/51.03; 310/71; 318/739, 749

[56] References Cited

U.S. PATENT DOCUMENTS

| | | | |
|---|---|---|---|
| 2,792,559 | 5/1957 | Maberry | 339/32 R |
| 3,477,001 | 11/1969 | Spinrad et al. | 310/71 |
| 3,509,513 | 4/1970 | Russin | 339/14 R |
| 3,611,257 | 10/1971 | Carkhuff | 339/218 M |
| 4,025,139 | 5/1977 | Martucci | 339/14 R |

FOREIGN PATENT DOCUMENTS

| | | | |
|---|---|---|---|
| 603975 | 6/1948 | United Kingdom | 339/60 M |
| 486412 | 12/1975 | U.S.S.R. | 339/14 R |

*Primary Examiner*—Neil Abrams

*Attorney, Agent, or Firm*—Bacon & Thomas

[57] ABSTRACT

A pin-and-socket type reversing plug connector for three-phase alternating current motors has three phase pins and two internally connected ground pins in a motor-connected member and corresponding sockets in a line-connected member. The five pins and sockets are arranged in a straight line, with a phase pin in the middle with the two ground pins on either side of the central pin. To reverse direction of rotation of the motor, the two connector members are unplugged, one member is rotated 180°, and the two members then rejoined.

7 Claims, 4 Drawing Figures

REVERSING PLUG CONNECTOR

BACKGROUND OF THE INVENTION

This invention relates to a motor reversing plug connector, particularly for use with three-phase alternating current motors.

Reversal of direction of rotation of three-phase motors is accomplished by simply reversing two of the three line connections to the motor. In permanent installations, particularly where the need to reverse rotational direction is infrequent, no special means are ordinarily provided to rapidly reverse the external connections of the motor. However, should the need arise, it is then necessary to remove the cover plate of the connection box and manually reverse two of the three line connections to the motor. On the other hand, where a machine being driven by a three-phase motor must be reversible during use, this is usually accomplished either by providing a reversible transmission; or the same can be accomplished with a double-pole-double-throw switch in the circuit, connected to reverse two of the three leads to the motor. Both of these systems generally are intended for relatively permanent installations and can become somewhat cumbersome where portability or mobility are desired.

It is, accordingly, one object of this invention to provide an inexpensive, easily-manipulated reversing connector for a three-phase system. Another object is to provide such a connector having ground pins so located as to permit reversal of phase while maintaining the ground connections in either direction. A further object is to provide a connector permitting the use of readily available four-conductor cable in which one of the conductors is used for grounding purposes. Yet another object is to provide a connector which can be effectively sealed against entry of water and which is not easily pulled apart by accident.

The foregoing and other objects which will become apparent to those skilled in this art are accomplished by means of the present invention which will be more fully understood from the description below and from the accompanying drawings:

SUMMARY OF THE INVENTION

The reversing connector in accordance with the present invention comprises a separable, two-member pin and socket combination having three phase connections and two ground connections in each member. The pins or sockets of any given pair of adjacent phase connections are always separated by an intervening ground connection, the two ground connections in each member being internally connected to each other. Thus, only a single ground wire is needed from each member of the connector.

DESCRIPTION OF PREFERRED EMBODIMENT

Figure 1:
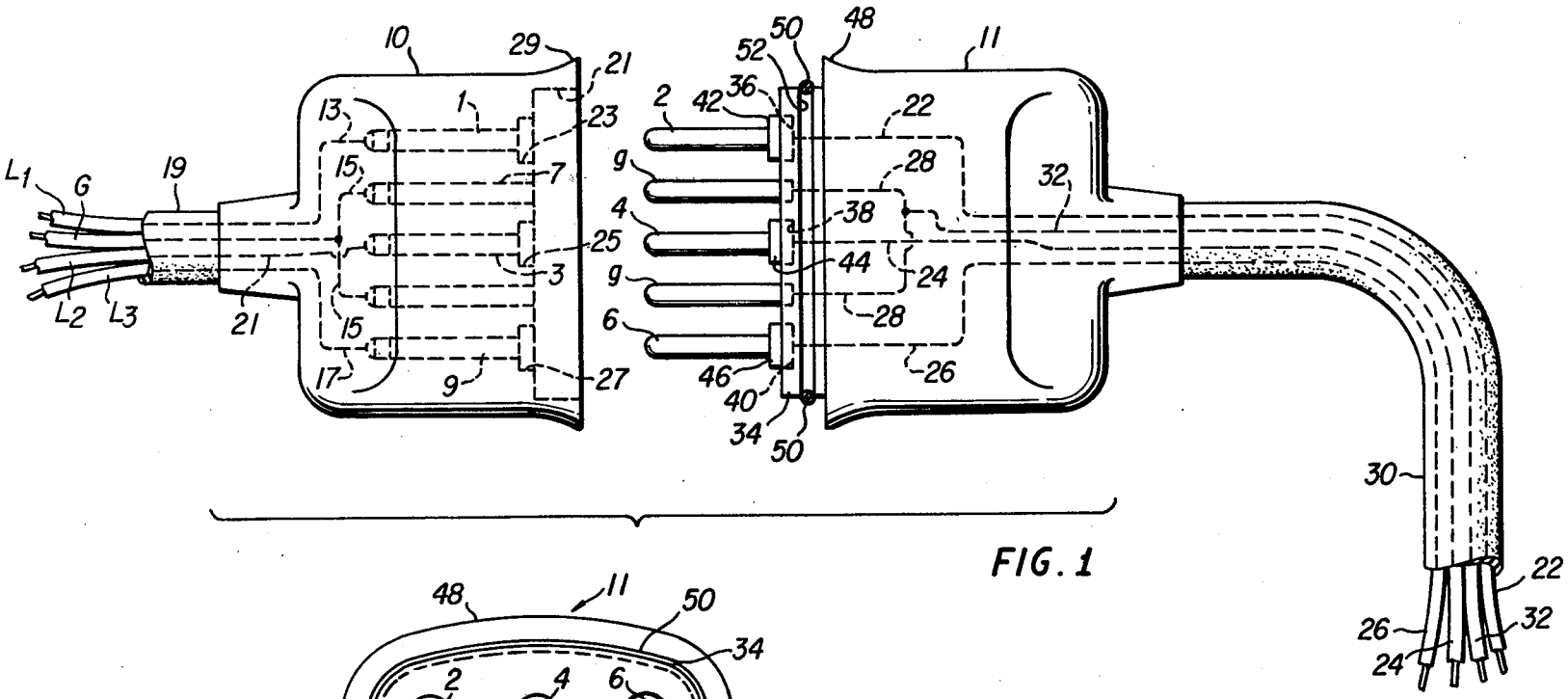
FIG. 1 is an exploded view of the two members of the connector combination in accordance with this invention.

Referring to FIG. 1, it will be seen that the connector, in accordance with a preferred form of the present invention, comprises a socket-bearing member 10 and a pin-bearing member 11. The two members are preferably molded from rubber or from any of the commercially available, synthetic insulating resins, such as, for example, the phenolics or the various vinyl resins. A four-conductor cable 30, having three hot conductors 22, 24, and 26 and ground conductor 32 is molded into pin-bearing member 11 so that the three conductors 22, 24 and 26 extend to and are soldered or otherwise electrically connected to phase pins 2, 4 and 6, respectively. Pin-bearing 11 is also provided with two ground pins g which are internally connected by a wire 28 molded into the body of the member 11. Ground wire 32 is connected to wire 28, thus making it possible to use a readily available four-conductor cable with a five-pin plug. The front end of pin-bearing member 11 is molded to form an extension 34 on the front face of the member and is provided with recesses 36, 38 and 40. Insulating plastic bushings 42, 44 and 46 are forced into recesses 36, 38 and 40, respectively, to provide additional electrical insulation between the phases and between the phase pins and the ground pins. These insulating bushings also provide further support for the phase pins.

Figure 2:
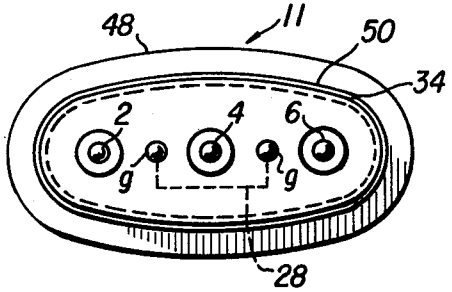
FIG. 2 is a front end view of the pin-bearing member.

As will be seen from FIG. 2, the cross section of both the pin-bearing and socket-bearing members is generally oval or elliptical, with the five pins, 2, g, 4, g, and 6 disposed substantially along the major axis in the order stated. Sockets 1, 7, 3, 9 and 5 are also disposed along the major axis of oval shaped member 10.

Figure 3:
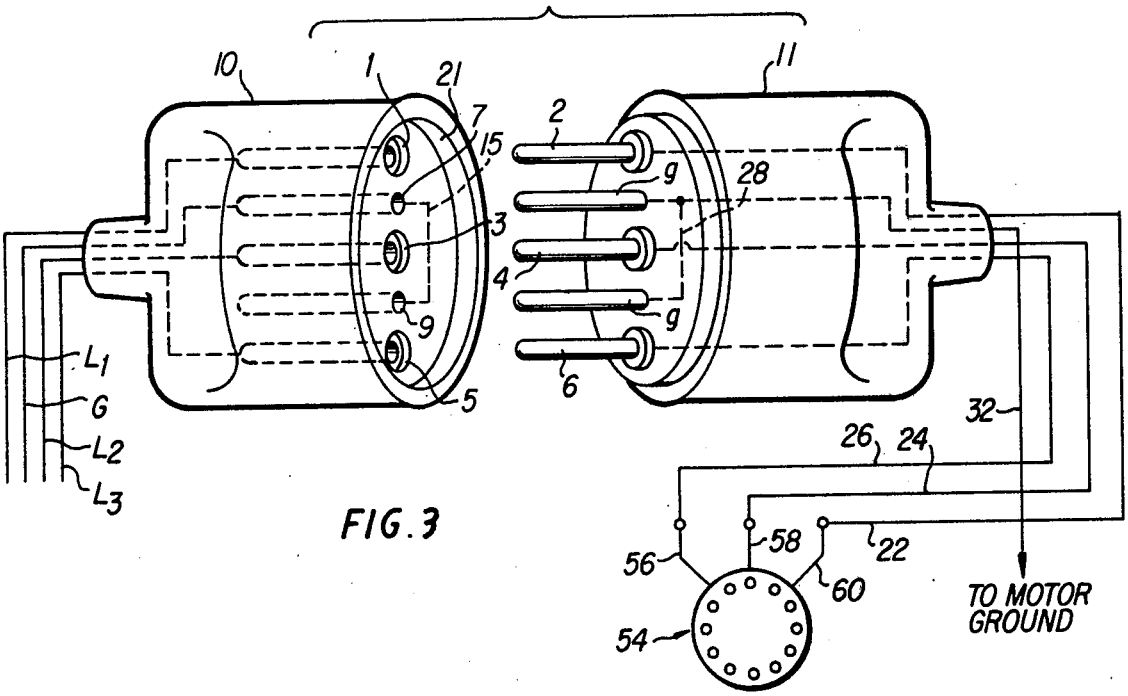
FIG. 3 is an exploded, schematic view, in perspective, of the reversing connector showing the connections to a three-phase motor for clockwise rotation.
Figure 4:
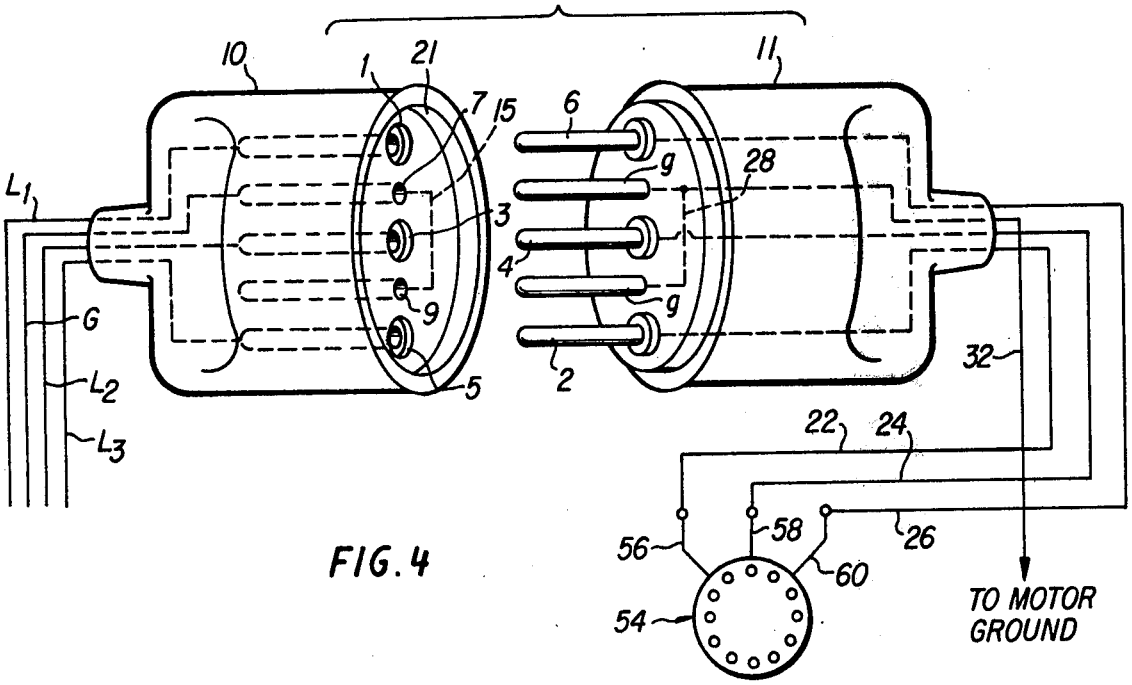
FIG. 4 is a view, similar to that of FIG. 3, showing the pin-bearing member rotated 180° to cause counterclockwise rotation of the motor.

Referring once more to FIG. 1 and to socket-bearing member 10 in particular, the latter will be seen to be molded so as to be provided with recesses to mate with the corresponding extending and protruding elements on pin-bearing member 11. Thus, the member 10 which, as seen from FIGS. 3 and 4, is also of a generally oval or elliptical cross section has molded into it a row of recessed conducting sockets 1, 7, 3, 9, and 5, located to receive pins 2, g, 4, g, and 6, respectively. The sockets 1, 7, 3, 9 and 5 are made of any suitable conducting metal, such as copper or brass, and are of a size to provide a tight fit and good electrical contact with their respective pins. As in the case of ground pins g in pin-bearing member 11, the ground sockets 7 and 9 are internally connected to each other, this being accomplished by wire 15 molded into the body of socket-bearing member 10. A four-conductor cable 19, similar to cable 30, is also molded into the body member 10, and internally electrically connected to sockets 1, 3, and 5 by means of wires 13, 21 and 17, respectively. The cable 19 is in turn connected to any suitable source of three-phase alternating current to provide line connections $L_1$, $L_2$, and $L_3$ to pin sockets 1, 3 and 5, respectively. Ground wire G is internally connected to wire 15, thus providing a common ground for ground pin sockets 7 and 9.

Typically, cables 19 and 30 may be No. 14, 4-wire cables; but it will be obvious that the two members of the connector can be made of a size to accept any available four-wire cable.

As mentioned above, sockets 1, 7, 3, 9, and 5 are selected to provide a tight mechanical fit and good electrical contact with their respective pins. To further insure against relative movement between the two members of the assembled connector, the body of socket member 10 is provided with recesses 23, 25, and 27 for the protruding portions of insulating bushings 42, 44 and 46, respectively, as illustrated in FIG. 1. A recess 21 is also provided in the body of socket member 10 to receive the extension 34 on pin member 11. All of the mentioned recesses are of such dimensions as to provide tight fits and thus minimize relative movement between the pin-bearing and socket bearing members. To further insure a tight fit and to seal the pins and their receptacles against possible entrance of water, the extended body portion 34 on pin member 11 is provided with a groove 52 into which is placed a rubber O-ring 50. The cross section fo the O-ring and its diameter are such as to cause the ring to extend beyond the periphery of extension 34 so as to provide a resilient seal when the pin-bearing and socket-bearing members are assembled for use.

As still further insurance against entrance of water and to prevent possible accidental separation of the two members of the assembled connector, socket-bearing member 10 and pin-bearing member 11 are molded with matching circumferential, outwardly flared lips 29 and 48, respectively. When the connector is assembled and in use, several layers of tape may be applied around the lips 29 and 48 to further ensure the mechanical integrity of the assembly as well as to apply some additional pressure on O-ring 50.

In use, and assuming for purposes of illustration, that a particular motor 54 is internally wired to rotate clockwise when phase pins 2, 4 and 6 are oriented as shown in FIG. 3, it is only necessary to initially connect the socket member 10 to a suitable source of three-phase a.c. and then to insert pin member 11 into socket member 10 so that phase pins 2, 4 and 6 are connected to sockets 1, 3, and 5, and to thus lines $L_1$, $L_2$, and $L_3$, respectively. When this is done, phase pins 2, 4 and 6 are connected to motor terminals 60, 58 and 56 through wires 22, 24, and 26, respectively.

To reverse rotation of motor 54 to a counterclockwise direction, it is only necessary to separate the connector members 10 and 11, rotate one of them, for example, pin member 11, 180°, and then reconnect the two members. When this is done, as illustrated in FIG. 4, phase pins 6, 4, and 2 are now connected with pin sockets 1, 3, and 5, and thus to lines $L_1$, $L_2$, and $L_3$, respectively, on one side, and to motor terminals 60, 58, and 56 through wires 26, 24, and 22, respectively on the other. Since reversal of rotation is accomplished by merely reversing two of the phase connections in a three-phase circuit, this is easily accomplished by means of the present invention because the third phase pin 4 is centrally located and does not change position when either the pin-bearing member or the socket-bearing member is rotated. Similarly, because ground pins g are interconnected, the ground connection to motor 54 through wire 32 does not change.

It will be understood that, with reference to FIGS. 3 and 4, the latter are simplified schematic diagrams only and were so shown merely to aid in describing the operation of the invention. The usual starting and control equipment required in the actual operation of, in particular, heavy electrical machinery, have been omitted to avoid unnecessary complication of the drawings. From the foregoing description it will be apparent that the connector of the present invention, in addition to being of novel structure, also possesses certain novel functional advantages. Thus, by using three phase pins and two interconnected ground pins, phase reversal can be accomplished without disturbing the ground connections to the motor. By arranging the five pins in a straight line and placing the two ground pins on either side of a centrally-located phase pin, phase reversal can be accomplished by merely rotating one of the connector members 180° so that the positions of the phase pins at the ends are interchanged. Furthermore, positioning of the two ground pins on either side of and adjacent the center phase pin places a ground pin between any pair of adjacent phase pins and prevents an accidental phase-to-phase short circuit by first short circuiting to one of the ground pins. A further novel advantage stems from the oval or elliptical cross section of the two connector members. This shape, particularly in conjunction with the out-flaring lip and the application of tape to the latter, increases the mechanical integrity of the assembled connector and decreases the possibility of accidental separation or entry of water. It will be realized, however, that it is not absolutely necessary to tape the connector and that other cross section shapes can be used without departing from the spirit of this invention. Thus, it will be apparent to those skilled in the art that the preferred linear arrangement of the five pins and sockets can be achieved with other cross sections, such as, rectangular, square, and even circular. Accordingly, this invention is not to be limited by the embodiment shown in the drawings and described above, which are given by way of illustration only, but only in accordance with the scope of the appended claims.

What is claimed is:

1. A reversing connector for a three-phase alternating current motor comprising:

(a) a first connector member having five pin terminals embedded therein in a straight line, said pin terminals extending outward from a face of said first connector member;

(b) a first multi-connector cable for connection at one end thereof to the terminals of a three-phase alternating current motor, the other end of said first cable being embedded in said first connector member, each of three conductors of said first cable being connected to one of a group of three separate pin terminals in said first member;

(c) a second connector member having five socket terminals embedded therein dispersed in a matching straight line to said pin terminals in said first connector member for receiving said pin terminals, the central terminal in each connector member being a phase terminal;

(d) a second multi-conductor cable for connection at one end thereof to a source of three-phase alternating current, the other end of said second cable being embedded in said second member, each of three conductors of said second cable being connected to one of a group of three separate socket terminals in said second member, said three socket terminals being disposed to match the location of and to connect with three pin terminals;

(e) a further pair of pin terminals constituting ground connection terminals, said further pair of pin terminals being internally connected to each other within the body of said first connector member disposed on either side of the central pin terminal and also connected to a fourth conductor in said first cable; and (f) a further pair of socket terminals constituting ground connection terminals, said further pair of socket terminals being internally connected to each other within the body of said second connector member disposed on either side of the central socket terminal and also connected to a fourth conductor in said second cable, said further pair of socket terminals being disposed to connect with said further pair of pin terminals whereby joining of the two connector members will cause a three-phase alternating current motor to rotate in a given, predetermined direction and rotation of one of said connector members 180° will cause reversal of two of said phase connections and reversal of direction of rotation of said motor.

2. A reversing connector in accordance with claim 1 wherein the groups of three pin terminals and three socket terminals comprise the phase connections and the further pairs of pin terminals and socket terminals comprise ground connections.

3. A reversing connector in accordance with claim 2 wherein adjacent phase terminals are separated from each other by ground terminals.

4. A reversing connector in accordance with any one of claims 1, 2, or 3 wherein the connector members are each of oval or elliptical cross section and the respective terminals are disposed along the major axis of said oval or elliptical cross section.

5. A reversing connector in accordance with claim 4 wherein an outwardly flaring lip is formed along the peripheries of the adjacent faces of the connector members.

6. A reversing connector in accordance with claim 5 wherein sealing means are provided on at least one of the connector members.

7. A reversing connector in accordance with claim 6 wherein insulating support means are embedded in the first connector member around the base of each phase pin terminal.

* * * * *